US007305971B2

(12) United States Patent
Fujii

(10) Patent No.: US 7,305,971 B2
(45) Date of Patent: Dec. 11, 2007

(54) FUEL INJECTION SYSTEM ENSURING OPERATION IN EVENT OF UNUSUAL CONDITION

(75) Inventor: Hiroto Fujii, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/334,748

(22) Filed: Jan. 19, 2006

(65) Prior Publication Data

US 2007/0028895 A1 Feb. 8, 2007

(30) Foreign Application Priority Data

Jan. 21, 2005 (JP) ..... 2005-014670

(51) Int. Cl.
*F02M 57/02* (2006.01)
*F02M 51/00* (2006.01)

(52) U.S. Cl. ..... 123/479; 123/490

(58) Field of Classification Search ..... 123/198 D, 123/479, 490, 494, 446–447, 456, 467, 472, 123/478; 73/117.3, 119 A
See application file for complete search history.

(56) References Cited

U.S. PATENT DOCUMENTS

| | | | | |
|---|---|---|---|---|
| 6,578,555 | B2 * | 6/2003 | Sykes | 123/479 |
| 6,622,692 | B2 * | 9/2003 | Yomogida | 123/299 |
| 6,622,702 | B2 * | 9/2003 | Yomogida et al. | 123/478 |
| 6,705,296 | B2 | 3/2004 | Horstmann et al. | |
| 6,712,047 | B2 * | 3/2004 | Rueger | 123/479 |
| 6,907,864 | B2 * | 6/2005 | Takemoto | 123/478 |
| 6,964,262 | B2 * | 11/2005 | Hayakawa | 123/458 |
| 7,010,415 | B2 * | 3/2006 | Dolker | 701/107 |
| 7,025,028 | B2 * | 4/2006 | Dolker | 123/179.17 |
| 7,143,747 | B2 * | 12/2006 | Uchiyama | 123/456 |
| 2004/0020463 | A1 * | 2/2004 | Anderson et al. | 123/446 |
| 2005/0126534 | A1 * | 6/2005 | Kikutani | 123/299 |
| 2005/0199219 | A1 * | 9/2005 | Utsumi | 123/458 |
| 2005/0229898 | A1 * | 10/2005 | Kikutani et al. | 123/299 |
| 2006/0130813 | A1 * | 6/2006 | Dolker | 123/458 |

FOREIGN PATENT DOCUMENTS

| | | | |
|---|---|---|---|
| JP | 10-227268 | * | 8/1998 |
| JP | 2000-265896 | * | 9/2000 |
| JP | 2002-339787 | * | 11/2002 |
| JP | 2003-176746 | * | 6/2003 |
| JP | 2004-502070 | | 1/2004 |
| JP | 2006-77709 | * | 3/2006 |

* cited by examiner

*Primary Examiner*—Hai Huynh
(74) *Attorney, Agent, or Firm*—Nixon & Vanderhye P.C.

(57) ABSTRACT

A common rail fuel injection apparatus for an engine is provided which is equipped with a rail pressure sensor working to measure the pressure of fuel in a common rail, fuel injectors, and a controller. When the operation state of the rail pressure sensor monitored to be unusual, the controller changes the value of electricity supplied to an actuator of one of the fuel injectors to induce a change in a preselected operation characteristic of the engine. Upon appearance of such a change, the controller estimates the value of the rail pressure using the changed value of the electricity and a physical property of balance among forces acting on a valve of one of the fuel injectors which has induced the change in operation characteristic of the engine. The estimated value of the rail pressure is used for subsequent injections of the fuel into the engine.

14 Claims, 8 Drawing Sheets

FUEL INJECTION SYSTEM ENSURING OPERATION IN EVENT OF UNUSUAL CONDITION

CROSS REFERENCE TO RELATED DOCUMENT

The present application claims the benefit of Japanese Patent Application No. 2005-14670 filed on Jan. 21, 2005, the disclosure of which is incorporated herein by reference.

BACKGROUND OF THE INVENTION

1. Technical Field of the Invention

The present invention relates generally to a common rail fuel injection system designed to ensure the stability of operation of an engine in the event of an operating problem.

2. Background Art

There are known accumulator fuel injection systems designed to inject fuel into an internal combustion engine at high pressure through a common rail. Such systems are usually employed in injecting the fuel to direct injection engines such as diesel engines.

Typically, fuel injection systems of the above type include a common rail in which fuel pressurized and discharged by a fuel pump is accumulated under high pressure, a rail pressure sensor working to measure the pressure of the fuel in the common rail (which will also be referred to as a rail pressure below), fuel injectors installed in the engine, and a controller working to control injection of the fuel into cylinders of the engine.

The controller monitors outputs from the rail pressure sensor or other sensors to actuate and control the injectors to spray the amount of fuel meeting operating requirements of the engine.

The rail pressure is one of quantities of state of the engine used to calculate commands to be outputted to the injectors which indicate the injection timing and the injection period. If the rail pressure sensor is changed in performance or has failed in operation thereof, it will impinge upon the operation of the engine undesirably.

In order to alleviate the above problem, U.S. Pat. No. 6,705,296 B2 to Horstmann et al. teaches a fuel injection system designed to correct a shift of zero point or offset error of the output of the rail pressure sensor when a given condition is encountered. Specifically, when the rate of drop of temperature of cooling water of the engine exceeds a given threshold level, e.g., when the engine is at rest, the system works to correct the offset error. The time the offset error is to be corrected may be determined using an output of a coolant temperature sensor in an inexpensive and simple manner.

The above system, however, can make the correction of the offset error only when the given condition is met. The number of the corrections is, therefore, not always sufficient for ensuring the stability of operation of the engine. The system is designed only to correct the offset error of the output of the rail pressure sensor and cannot always assure the stability of operation of the engine if another problem, such as a change in performance or a failure in operation of the rail pressure sensor, has occurred.

SUMMARY OF THE INVENTION

It is therefore a principal object of the invention to avoid the disadvantages of the prior art.

It is another object of the invention to provide an improved structure of a fuel injection system designed to ensure the stability of operation of an engine in the event of a problem such as a change in performance or failure in operation of a rail pressure sensor.

According to one aspect of the invention, there is provided a fuel injection apparatus for engines such as diesel engines. The fuel injection apparatus comprises: (a) a common rail accumulating fuel under a given pressure; (b) a rail pressure sensor working to measure a rail pressure that is pressure of the fuel in the common rail and provide an output indicative thereof; (c) fuel injectors each including an injector body, an injection valve, a pressure chamber, a control valve, a spring, and an actuator, the spring urging the control valve to close the pressure chamber, so that pressure in the pressure chamber acts on the injection valve to close a spray hole formed in the injector body, the actuator being supplied with electricity to move the control valve to open the pressure chamber, so that the pressure in the pressure chamber changes to move the control valve to open the spray hole for initiating injection of the fuel into a corresponding one of cylinders of an engine; (d) a controller working to control the electricity supplied to the actuator of each of the fuel injectors using the output from the rail pressure sensor for controlling the injection of the fuel into the engine and also monitor an operation state of the rail pressure sensor. When having determined that the operation state of the rail pressure sensor is unusual, the controller changes a value of the electric supplied to the actuator to determine whether a resulting change in a preselected operation characteristic of the engine has appeared or not. When it is determined that the resulting change has appeared, the controller calculates a value of the rail pressure using the changed value of the electricity and a physical property of balance among forces acting on the control valve of one of the fuel injectors which has induced the change in operation characteristics of the engine.

Specifically, the appearance of the resulting charge in preselected operation characteristic of the engine arising from the change (e.g., increase or decrease) in the value of the electricity to the actuator means that the one of the injectors has switched in operation from a fuel injection mode to a rest mode or vice versa. In the event of such a switch, a physical balance among the pressure of the spring urging the control valve to close the pressure chamber, the force, as produced by the pressure in the pressure chamber to move the control valve to open the spray hole, and the force, as produced by the actuator to move the control valve to open the pressure chamber, is established. The pressure of the spring is constant. The force produced by the pressure in the pressure chamber is substantially identical with the rail pressure (i.e., the pressure in the common rail) when the above physical balance is achieved. The rail pressure may, thus, be determined based on the force, as produced by the actuator, which is a function of the electricity supplied thereto. Accordingly, when the change in preselected operation characteristic of the engine has appeared, the rail pressure may be determined as a function of the electricity.

In the preferred mode of the invention, the controller may work to correct a correlation between the rail pressure and the output of the rail pressure sensor using the calculated value of the rail pressure and an actual value of the output from the rail pressure sensor, as sampled when it is determined that the resulting change in the preselected operation characteristic of the engine has appeared. The controller uses the corrected correlation control the electricity to the fuel injectors for subsequent injection of the fuel into the engine.

The controller may use the calculated value of the rail pressure to control operations of the fuel injectors for subsequent injections of the fuel into the engine. This eliminates the need for an output of the rail pressure sensor.

The controller may select one of the cylinders of the engine as a target cylinder to be monitored in the resulting change in the preselected operation characteristic of the engine. The controller changes the value of the electricity supplied to one of the fuel injectors which is provided for the target cylinder cyclically until the resulting change in the preselected operation characteristic of the engine appears and calculates the value of the rail pressure using the value of the electricity changed upon appearance of the resulting change in the preselected operation characteristic and the physical property of balance among forces acting on the control valve of the one of the fuel injectors for controlling operations of others of the fuel injectors for subsequent injections of the fuel into the engine.

The preselected operation characteristic of the engine may be an increase in revolution of the engine during an expansion stroke thereof.

The actuator of each of the fuel injectors may be implemented by a solenoid which is supplied with an electric current to produce a magnetic attraction acting on the control valve to open the pressure chamber. The level of the electricity to be changed by the controller to induce the change in the preselected operation characteristic of the engine may be a maximum value of the electric current.

The actuator of each of the fuel injectors may alternatively be implemented by a piezoelectric device which is responsive to input of voltage to expand to move the control valve to open the pressure chamber. The level of the electricity to be changed by the controller to induce the charge in the preselected operation characteristic of the engine may be a maximum value of the voltage applied to the piezoelectric device.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a view which shows another solenoid excitation pattern which schedules a sequential change in current to be applied to a solenoids of injectors;

FIG. 6(*b*) is a view which shows a time-sequential change in current applied to a solenoid of an injector;

DESCRIPTION OF THE PREFERRED EMBODIMENTS

Figure 1:
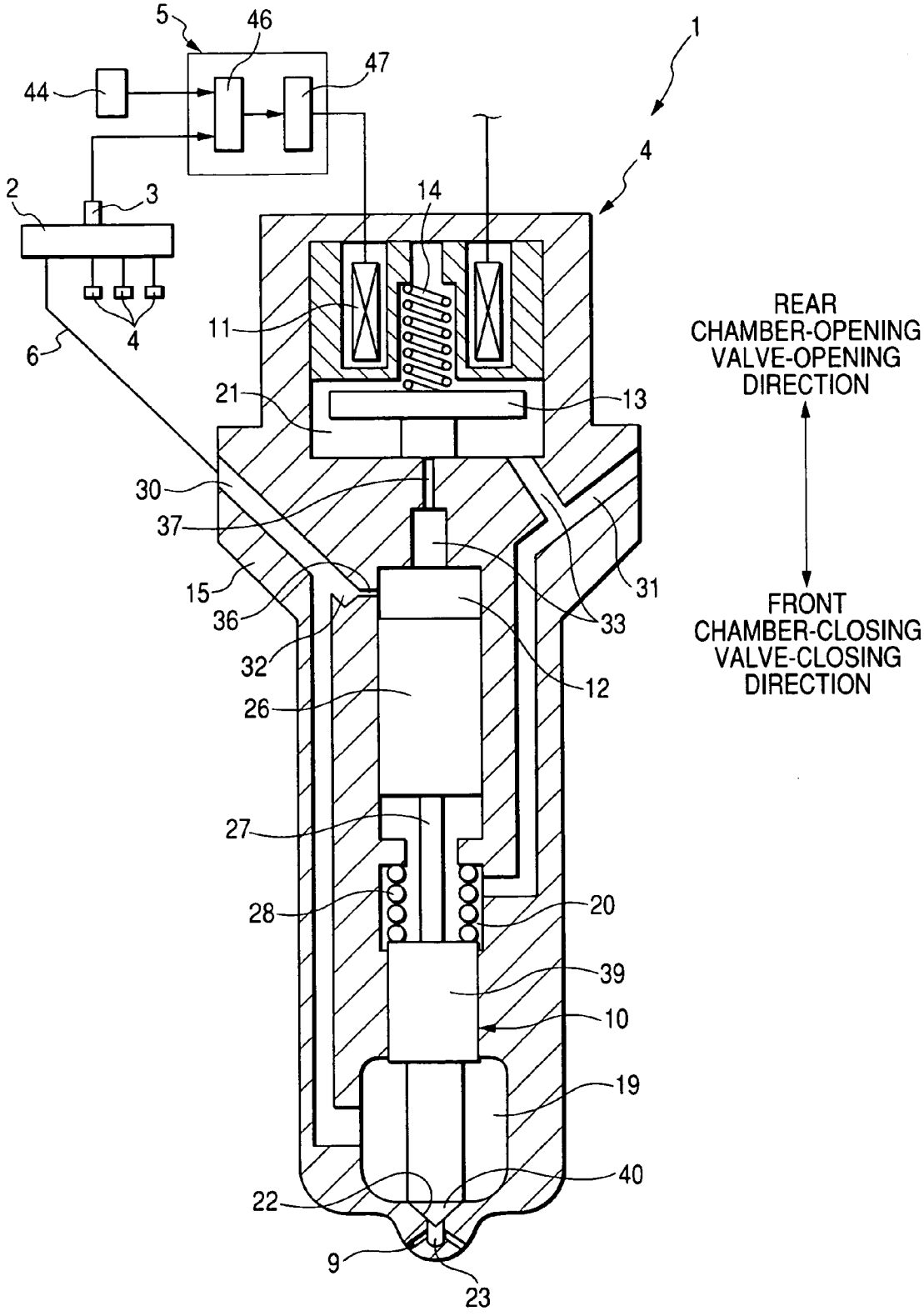
FIG. 1 is a block diagram which shows a fuel injection apparatus according to the first embodiment of the invention.

Referring to the drawings wherein like reference numbers refer to like parts in several views, particularly to FIG. 1, there is shown an automotive fuel injection apparatus 1 according to the first embodiment of the invention.

The fuel injection apparatus 1, as referred to herein, is engineered as a common rail injection apparatus for internal combustion engines such as four-cylinder direct fuel injection diesel engines.

The fuel injection apparatus 1 includes a common rail 2 in which fuel pressurized and discharged by a fuel pump (not shown) is accumulated, a rail pressure sensor 3, fuel injectors 4, and a controller 5. The rail pressure sensor 3 works to measure the pressure of the fuel within the common rail 2 and output a signal indicative thereof to the controller 5. Each of the fuel injectors 4 connects with the common rail 2 and works to spray fuel into one of cylinders of the engine. The controller 5 works to monitor an output of the rail pressure sensor 3 to control operations of the fuel injectors 4.

The common rail 2 has a typical structure and connects with each of the fuel injectors 4 through a high-pressure pipe 6. The rail pressure sensor 3 is installed in the common rail 2.

Each of the injectors 4 receives a supply of the fuel from the common rail 2 and injects it into a corresponding one of the cylinders of the engine. Each of the injectors 4 consists essentially of a needle valve 10, an actuator or solenoid 11, a control valve 13, a spring 14, and an injector body 15. The injector body 15 has spray holes 9 formed in a head thereof and a back pressure chamber 12 formed therein. The spring 14 urges the control valve 13 to close a back pressure chamber 12 at all the time. The solenoid 11 is supplied with electric power from a power supply (not shown) to magnetically attract the control valve 13 against the spring load produced by the spring 14 so open the back pressure chamber 12, thereby moving the needle valve 10 to open the spray holes 9 selectively.

The injector body 15 has formed therein a fuel sump 19 to which the fuel is supplied to be sprayed from the spray holes 9, the back pressure chamber 12 in which the fuel pressure (i.e., back pressure) is produced to urge the needle valve 10 in a valve-closing direction to close the spray holes 9, a leaking fuel reservoir 20 storing therein the fuel leaking from the fuel sump 19 or the back pressure chamber 12, and the control valve chamber 21 in which the control valve 13 is disposed.

The fuel pressure in the fuel sump 19 acts on the needle valve 10 to move it in a valve-opening direction to open the spray holes 9. The injector body 15 has formed on a top end (i.e., a lower end, as viewed in the drawing) of an inner wall defining the fuel sump 19 a valve seat 22 on which a conical head of the needle valve 39 is to be seated. The valve seat 22 leads to the spray holes 9 through a sack volume 23.

The back pressure chamber 12 is closed by a command piston 26. Specifically, the volume of the back pressure chamber 12 is changed by movement of the command piston 26 arising from supply or discharge of the fuel into or from the back pressure chamber 12, thereby changing the back pressure acting on the back end of the command piston 26. The command piston 26 works to transfer the back pressure to the needle valve 10 through the pressure pin 27. Additionally, the fuel pressure in the fuel sump 19 is also transmitted to the command piston 26 through the pressure pin 27.

The leaking fuel reservoir 20 has disposed therein a coil spring 28 which works to urge the needle valve 10 in the valve-closing direction at all the time.

The injector body 15 also has formed therein a high-pressure fuel path 30, a low-pressure fuel path 31, a back pressure supply path 32, and a back pressure drain path 33. The high-pressure fuel path 30 connects with the common rail 2 through the high-pressure pipe 6 to supply the high pressure of fuel from the common rail 2 to the fuel sump 19. The low-pressure fuel path 31 leads to the leaking fuel reservoir 20 to drain the fuel therefrom. The back pressure supply path 32 is branched from the high-pressure fuel path 30 to supply the fuel to the back pressure chamber 12. The back pressure drain path 33 extends from the back pressure chamber 12 to the low-pressure fuel path 31 through the control valve chamber 21 to drain the fuel out of the back pressure chamber 12.

The back pressure supply path 32 has an inlet orifice 36 which works to limit the rate of flow of the fuel into the back pressure chamber 12. The back pressure drain path 33 has an outlet orifice 37 which works to limit the rate of discharge of the fuel from the back pressure chamber 12. The outlet orifice 37 is closed by the control valve 13 when the solenoid 11 is deenergized and opened when the solenoid 11 is energized. The outlet orifice 37 is greater in diameter than the inlet orifice 36, so that when the outlet orifice 37 is opened, it will cause the rate of fuel flowing out of the back pressure chamber 12 to be greater than that flowing into the back pressure chamber 12, thus resulting in a drop in fuel pressure within the back pressure chamber 12.

The needle valve 10 is of a spool shape and has a cylindrical slider 39 formed on the rear thereof. The slider 39 is retained by the injector body 15 to be slidable in an axial direction of the needle valve 10. The needle valve 10 also has a tapered head 40 which is to be fitted on the seat 22 to block the fluid communication between the fuel sump 19 and the spray holes 9 to close the spray holes 9. When the needle valve 10 is lifted up to leave the head 40 from the seat 22 to open the spray holes 9.

The control valve 13 is disposed within the control valve chamber 21 and urged by the spring 14 to close the outlet orifice 30. When the solenoid 11 is deenergized, the control valve 13 continues to close the outlet orifice 30 to block the fluid communication between the back pressure chamber 12 and the low-pressure fuel path 31. When the solenoid 11 is energized, the control valve 13 is attracted upward to open the outlet orifice 30 to establish the fluid communication between the back pressure chamber 2 and the low-pressure fuel path 31.

When it is required to inject the fuel into the engine, the controller 5 turns on or energizes the solenoid 11, thereby causing the control valve 13 to open the back pressure chamber 12, so that the fuel pressure in the back pressure chamber 12 drops. This causes a valve-opening pressure (i.e., the fuel pressure in the fuel sump 19) urging the needle valve 10 in the valve-opening direction to overcome a valve-closing pressure (i.e., the sum of the fuel pressure in the back pressure chamber 12 and the spring load produced by the spring 28) urging the needle valve 10 in the valve-closing direction, so that the head 40 of the needle valve 10 leaves the seat 22 to open the spray holes 9. When it is required to terminate the injection of fuel into the engine, the controller 5 turns off or deenergizes the solenoid 11, thereby causing the control valve 13 to close the back pressure chamber 12, so that the fuel pressure in the back pressure chamber 12 rises. This causes the valve-closing pressure to exceed the valve-opening pressure, so that the head 40 of the needle valve 10 is seated on the seat 22 to close the spray holes 9.

The controller 5 consists of an ECU 46 and a solenoid driver 47. The ECU 46 is designed to monitor outputs of the rail pressure sensor 3 and the crank position sensor 44 to perform arithmetic operations and output an injection control signal. The solenoid driver 47 is responsive to the injection control signal to control the operation of the solenoid 11.

Specifically, the ECU 46 uses the outputs of the rail pressure sensor 3 and the crank position sensor 44 to calculate the urge (which will also be referred to as an injection timing below) when the spray holes 9 of each of the injectors 4 should be opened and the duration (which will also be referred to as an injection period below) for which the spray holes 9 should be kept opened. The ECU 46 determines the time when the injection control signal is to be outputted and the duration for which the injection control signal is kept outputted based on the injection timing and the injection period and outputs the injection control signal to the solenoid driver 47.

Figure 2A:
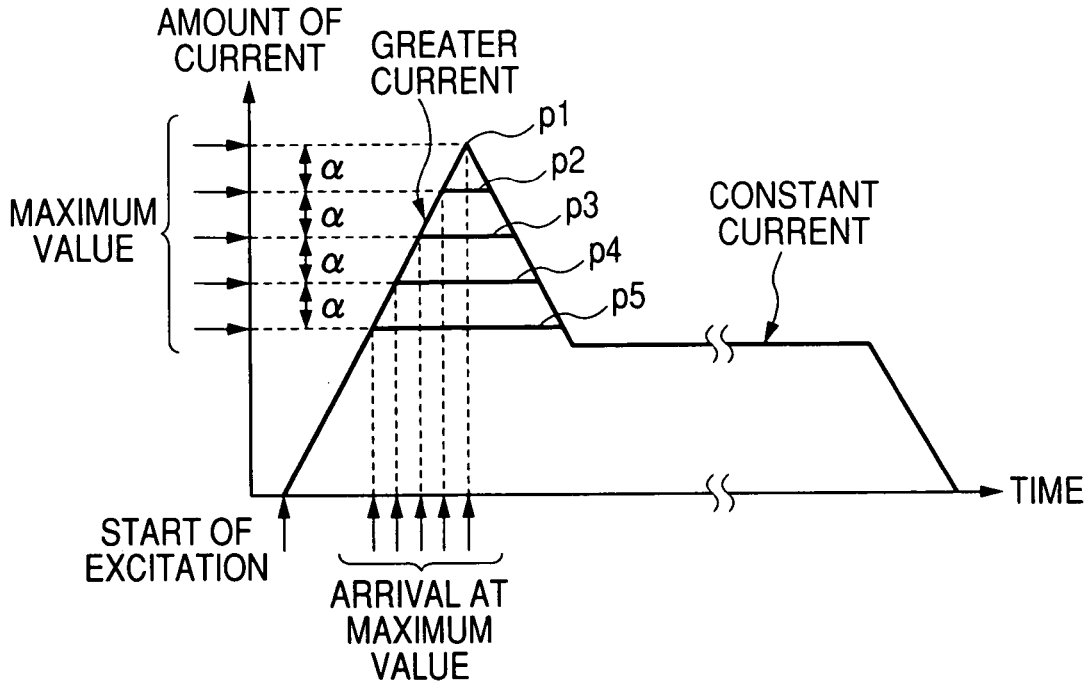
FIG. 2(*a*) is a view which shows a solenoid excitation pattern which schedules a sequential change in current to be applied to a solenoids of injectors.
Figure 2B:
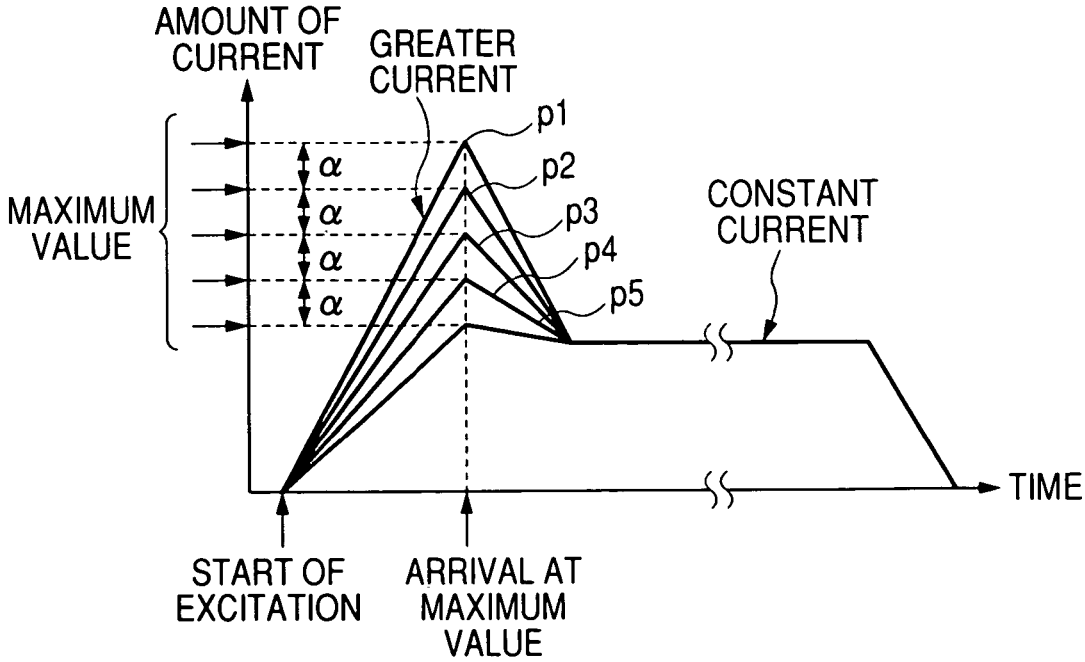

The solenoid driver 47 is responsive to the injection control signal to excite the solenoid 11 at the injection timing and keep it excited for the injection period. Specifically, the solenoid driver 47, as illustrated in FIGS. 2(*a*) and 2(*b*), supplies a greater current to the solenoid 11 at an initial stage to lift up the needle valve 10 from the seat 22 and a smaller constant current to the solenoid 11 at a subsequent stage to keep the needle valve 10 lifted up.

The feature of the fuel injection apparatus 1 will be described below with reference to FIGS. 2(*a*) to 3.

When determining that a failure in operation or an unusual condition of the rail pressure sensor 3 has been encountered, the controller 5 works to change maximum values of the greater currents to the fuel injectors 4, in sequence, in the same direction, monitor a resulting change in variation in revolution of the engine, and estimate or calculate the fuel pressure in the common rail 2 (which will be also referred to as a rail pressure below) based on the maximum value of the greater current, as applied to one of the injectors 4 upon detection of the change in variation in evolution of the engine, and a physical property of balance among forces acting on the control valve 13 of the one of the injectors 4 upon detection of the charge in variation in revolution of the engine.

The controller 5 also corrects a characteristic correlation, as stored therein, between the rail pressure and the output of the rail pressure sensor 3 using an actual output of the rail pressure sensor 3, as produced upon the detection of the change in variation in revolution of the engine, and the calculated rail pressure.

Figure 3:
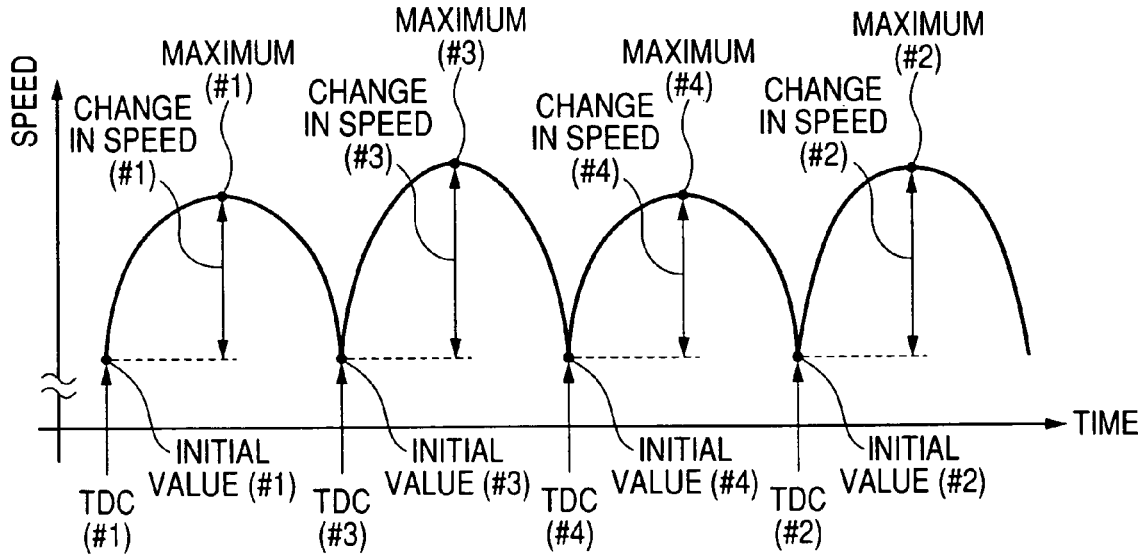
FIG. 3 is a view which shows a time-sequential change in speed of each piston of an engine.

The variation in revolution of the engine, as referred to herein, is one of characteristics of the engine which indicates the amount of increase in speed of the engine during an expansion stroke thereof. In the case of the four-cylinder engine, the variation in revolution of the engine may be defined, as demonstrated in FIG. 3, by a difference between an initial value and a maximum value of speed of one of cylinders during an interval between when the one of the cylinders has reached the top dead center thereof and when a subsequent one of the cylinders has reached the top dead center thereof. The variation in revolution of the engine may alternatively be given by the maximum value of the greater current or the initial value of the speed of the one of the cylinders of the engine itself or by an average of the maximum value and the initial value. In FIG. 3, #1, #3, #4, and #2 are numbers of the cylinders of the engine.

Figure 4:
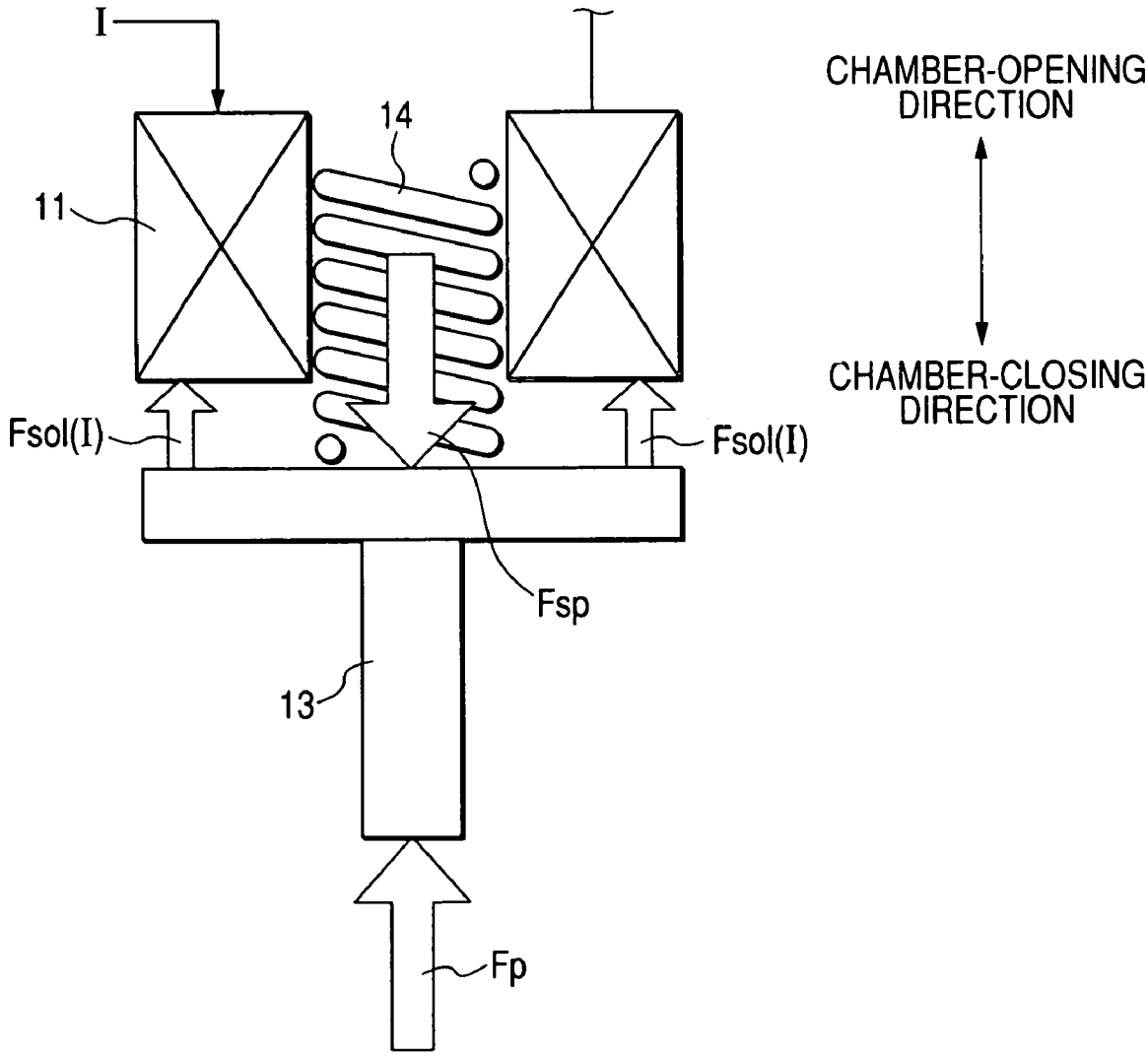
FIG. 4 is a schematic view which shows a physical balance among magnetic attraction, spring pressure, and pressure in a back pressure chamber which act on a control valve of an injector.

The balance of fuel pressure acting on the control valve 13 of the injector 4 will be described below using FIG. 4.

When the solenoid 11 is being energized, a combination of the spring pressure Fsp, as produced by the spring 14, the back pressure force Fp that is the force, as produced by the pressure in the back pressure chamber 12, lifting the control valve 13, and the magnetic attraction Fsol (I), as produced as a function of the magnitude of current I supplied to the solenoid 11, acts on the control valve 13.

The spring pressure Fsp is oriented in a chamber-closing direction to close the back pressure chamber 12. The back pressure force Fp is oriented in a chamber-opening direction to open the back pressure chamber 12. The magnetic attraction Fsol (I) is oriented in the chamber-opening direction.

At the time when a balance between the sum of the magnetic attraction Fsol (I) and the back pressure force Fp and the spring pressure Fsp is achieved, in other words, when an equation (1) below is met, the control valve 12 may be viewed as having started to move in the chamber-closing direction or the chamber-opening direction to close or open the back pressure chamber 12.

$$Fsp=Fsol(I)+Fp \quad (1)$$

Specifically, when the back pressure chamber 12 is closed or opened, it causes the injector 4 to be switched in operation from a fuel injection mode to a rest mode or vice versa. This also causes the change in variation in revolution of the engine to disappear or appear, that is, to be switched from some value to zero or from zero to some value.

When the sum of the magnetic attraction Fsol (I) and the back pressure force Fp is balanced with the spring pressure Fsp, the back pressure in the back pressure chamber 12 will be equal to the rail pressure. The back pressure force Fp may, thus, be expressed by the following equation.

$$Fp=Pc\times A \quad (2)$$

where Pc is the rail pressure, and A is an effective area of the control valve 13 on which the back pressure acts.

The spring pressure Fsp is constant. Therefore, when the above balance is achieved, that is, a transition occurs between detection and no detection of the change in variation in revolution of the engine, the rail pressure Pc may be expressed by an equation (3) below using the amount of current applied to the injector 4.

$$Pc=Fsp/A-Fsol(I)/A \quad (3)$$

The control operation of the fuel injection apparatus 1 will be described below with reference to FIGS. 2(*a*), 2(*b*), 5, 6(*a*), and 6(*b*).

Figure 5:
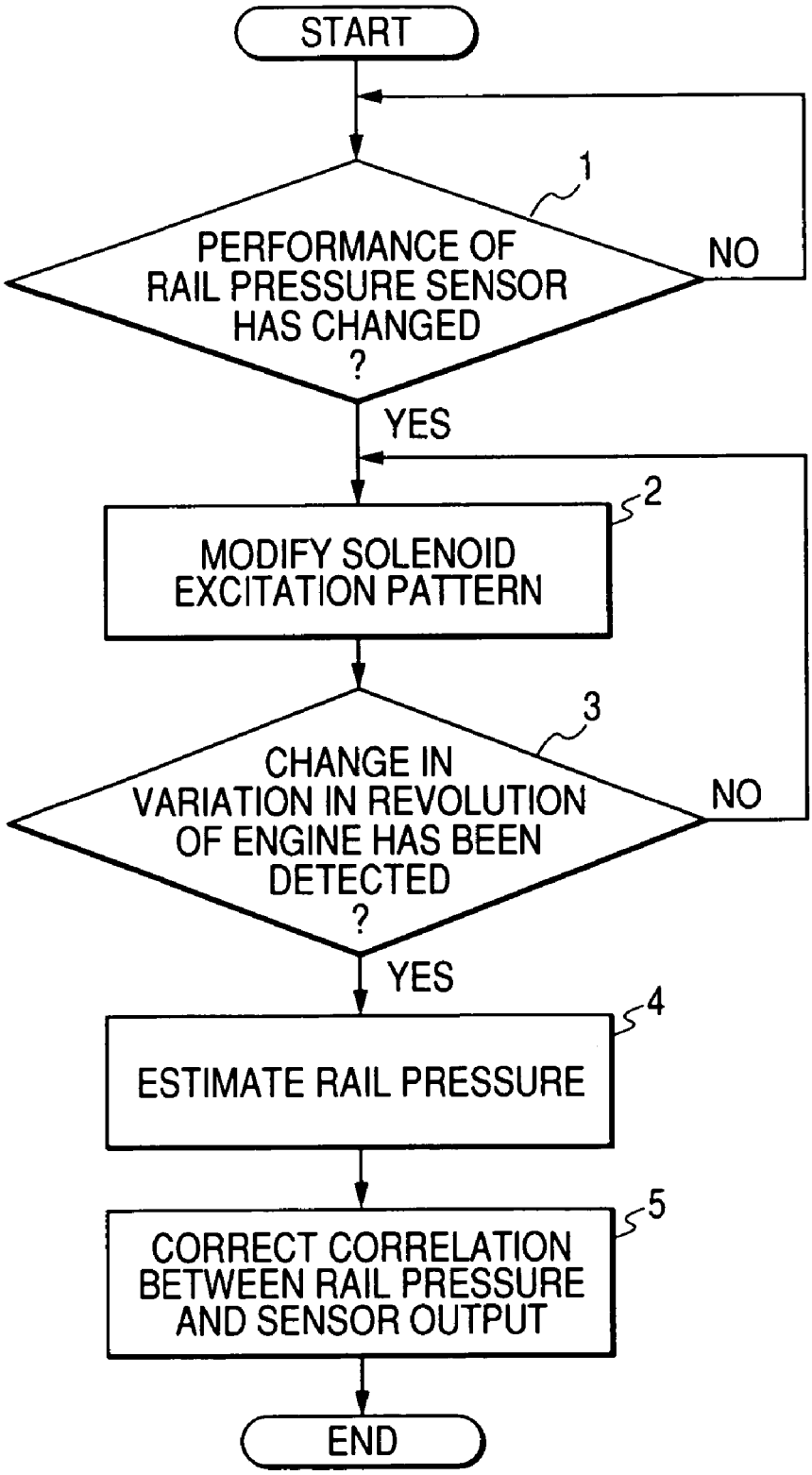
FIG. 5 is a flowchart of a program to be executed to estimate pressure in a common rail and correct a correlation between a rail pressure and a sensor output in the event of a change in performance of a rail pressure sensor.

FIG. 5 is a flowchart of a sequence of logical steps or program to be executed by the controller 5.

After entering the program, the routine proceeds to step 1 wherein it is determined whether the performance of the rail pressure sensor 3 has changed or not. If a YES answer is obtained meaning that the performance of the rail pressure sensor 3 has changed, then the routine proceeds to step 2. Alternative, if a NO answer is obtained, then the routine repeats step 1.

The determination in step 1 as to whether the performance of the rail pressure sensor 3 has changed or not may be made by checking whether the value of the rail pressure, as calculated by the output of the rail pressure sensor 3, is clearly erroneous or not, an offset error has appeared or not, or a condition in which the rail pressure sensor 3 may be viewed as having been aged is met or not, for example, a total travel distance of the vehicle equipped with the fuel injection apparatus 1 has exceeded a predetermined value or not.

In step 2, a solenoid excitation pattern scheduling a sequential change in current to be applied to the solenoids 11 of the injectors 4 is modified to decrease the maximum value of the greater current to be applied to the solenoids 11 of the injectors 4 by an amount α. The controller 5 looks up the modified solenoid excitation pattern and applies the current, as set thereby, to the solenoid 11 of a given one of the injectors 4.

The routine proceeds to step 3 wherein it is determined whether the change in variation in revolution of the engine has been detected or not. Specifically, when the variation in revolution of the engine, as produced by the fuel injection upon excitation of the solenoid 11 of the one of the injectors 4 in this program cycle, is substantially identical with that as produced by the fuel injection upon excitation of the solenoid 11 of a preceding one of the injectors 4 one program cycle earlier, it is determined in step 3 wherein the change is variation in revolution of the engine has not appeared, then the routine returns back to step 2 wherein the solenoid excitation pattern is modified to decrease the maximum value of the greater current to be applied to the solenoids 11 of the injectors 4 by the amount α. The controller 5 looks up the modified solenoid excitation pattern and applies the current, as set thereby, to the solenoid 11 of a subsequent one of the injectors 4.

When the current applied to the solenoid 11 of the injector 4 is decreased in step 2, thereby resulting in no injection of the fuel into the engine, which leads to a greater drop in the variation in revolution of the engine, a YES answer is obtained in step 3, then the routine proceeds to step 4. Specifically, step 3 works to determine whether the transition from detection to no detection of the change in variation in revolution of the engine has occurred or not. Step 2 continues to decrease, in sequence, the maximum value of the greater current to be applied to the solenoids 11 of the injectors 4 until step 3 determines that the change in variation in revolution of the engine has been detected.

Figure 6A:
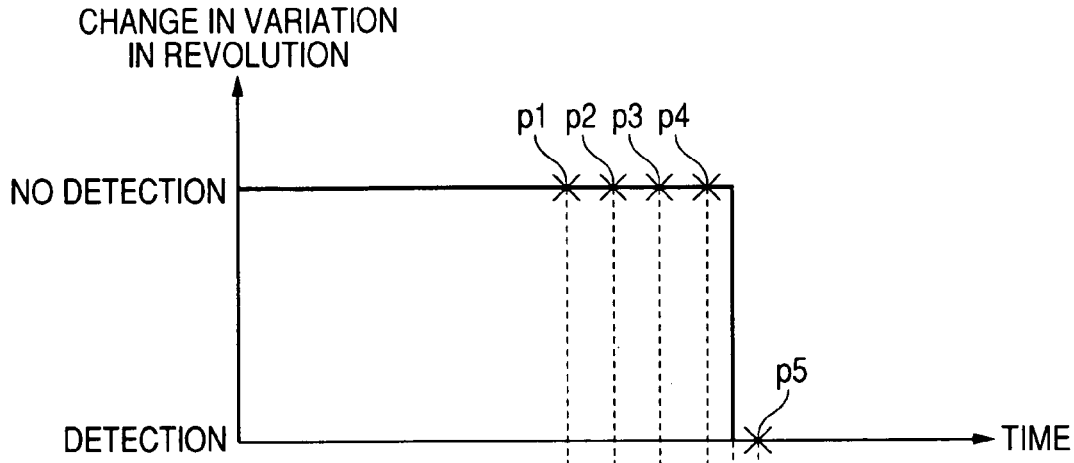
FIG. 6(*a*) is a view which shows a time-sequential change in variation in revolution of an engine.
Figure 6B:
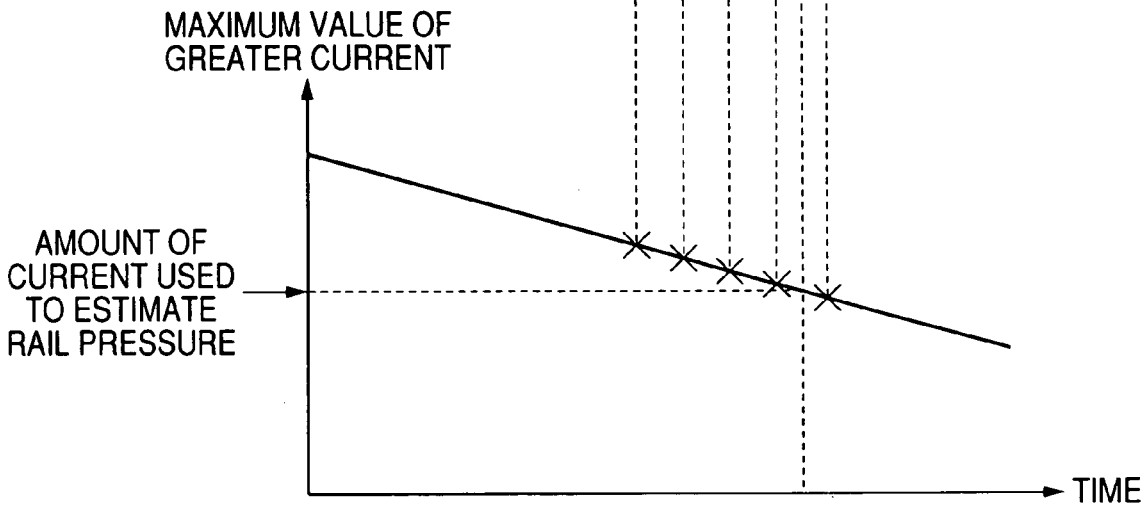

When step 2 is repeated, the maximum value of the greater current to be applied, in sequence, to the injectors 4 changes, as illustrated in FIG. 2(*a*) or 2(*b*), from p1→p2→p3→p4→p5. For example, if the maximum value of the greater current to be applied to the injectors 4 is changed, as demonstrated in FIG. 6(*a*), from p4 to p5, thereby resulting in a greater drop in the variation in revolution of the engine, the controller 5 determines that the transition from detection to no detection of the change an variation in revolution of the engine has been taken place.

The solenoid excitation pattern scheduling a sequential change an current to be applied to the solenoids 11 of the injectors 4 may be modified, as demonstrated either in FIG. 2(*a*) or 2(*b*). In the case of FIG. 2(*a*), the controller 5 shortens the time required by the current to reach the maximum value without changing the rate of increase in current up to the maximum value. In the case of FIG. 2(*b*), the controller 5 decreases the rate of increase in current up to the maximum value without changing the time required by the current to reach the maximum value.

If a YES answer is obtained in step 3 meaning that the change in variation in revolution of the engine has appeared, then the routine proceeds to step 4 wherein the rail pressure Pc is calculated according to Eq. (3), as described above. In. Eq. (3), Fsol(I) is, as already described, the magnetic attraction that is a function of the current I applied to the solenoid 11 of the injector 4. The current I may be the maximum value of the current, as indicated by p5 or p4 in either of FIG. 2(*a*) or 2(*b*), or an average of the maximum values of the currents p4 and p5.

Finally, the routine proceeds to step 5 wherein the controller 5 corrects the correlation between the rail pressure and the output of the rail pressure sensor 3 using the rail pressure Pc, as calculated in step 4, and an actual output of the rail pressure sensor 3, as sampled when the change in variation in revolution of the engine is detected. The corrected correlation is employed in controlling subsequent injections of the fuel into the engine.

As apparent from the above discussion the fuel injection apparatus 1 of this embodiment is designed to decrement, in sequence, the maximum values of currents to be applied initially to the respective injectors 4 to induce the difference in variation in revolution between the cylinders of the engine when it is determined that the rail pressure sensor 3 has failed, that is, the performance thereof has been changed. The fuel injection apparatus 1 estimates the fuel pressure in the common rail 2 using the maximum value of the current applied to the injector 4 upon detection of the difference in variation in revolution and the physical property of balance among forces acting on the control valve 13 of the injector 4.

At the time when the difference in variation in revolution between the cylinders of the engine appears, the sum of the magnetic attraction Fsol (I) and the back pressure force Fp is, as described above, balanced with the spring pressure Fsp. The spring pressure Fsp is constant. When the balance is achieved, the back pressure in the back pressure chamber 12 will be the same as the rail pressure (i.e., the pressure in the common rail 2). The rail pressure when the operation mode of the injectors 4 has been switched (i.e., the variation in revolution of the engine has changed) depends upon the magnetic attraction Fsol (I). The magnetic attraction Fsol (I) depends upon the amount (i.e., the maximum value) of current applied to the solenoid 11 of the injector 4. Therefore, the rail pressure may be determined as a function of the maximum value of current applied to the injector 4 accurately.

The fuel injector apparatus 1 also works to correct the correlation between the rail pressure and the output of the rail pressure sensor 3 using the calculated rail pressure and an actual output of the rail pressure sensor 3 and determine the amount of fuel to be injected to the engine by look-up using a map listing the correlation. This eliminates the need for calculating the rail pressure every injection of the fuel into the engine.

The fuel injection apparatus 1 according to the second embodiment will be described below.

The controller 5 is designed to monitor the operation of the rail pressure sensor 3 to determine whether a fault, such as a wire breakage or disconnection, has occurred in the rail pressure sensor 3 or not, change the maximum values of the greater currents to the fuel injectors 4, in sequence, in the same direction, monitor a resulting change in variation in revolution of the engine, and estimate or calculate the rail pressure below based on the maximum value of the greater current, as applied to one of the injectors 4 upon detection of the change in variation in revolution of the engine, and the physical property of balance among forces acting on the control valve 13 of the one of the injectors 4 upon detection of the change in variation in revolution of the engine, and control the injection of fuel into the engine using the calculated rail pressure.

The controller a selects one of the cylinders of the engine to monitor the change in variation in revolution of the engine and change the maximum value of current to be applied to one of the injectors 4 corresponding to the selected one of the cylinders cyclically to calculate the rail pressure using the maximum value of current upon appearance of he change in variation in evolution of the engine.

Figure 7:
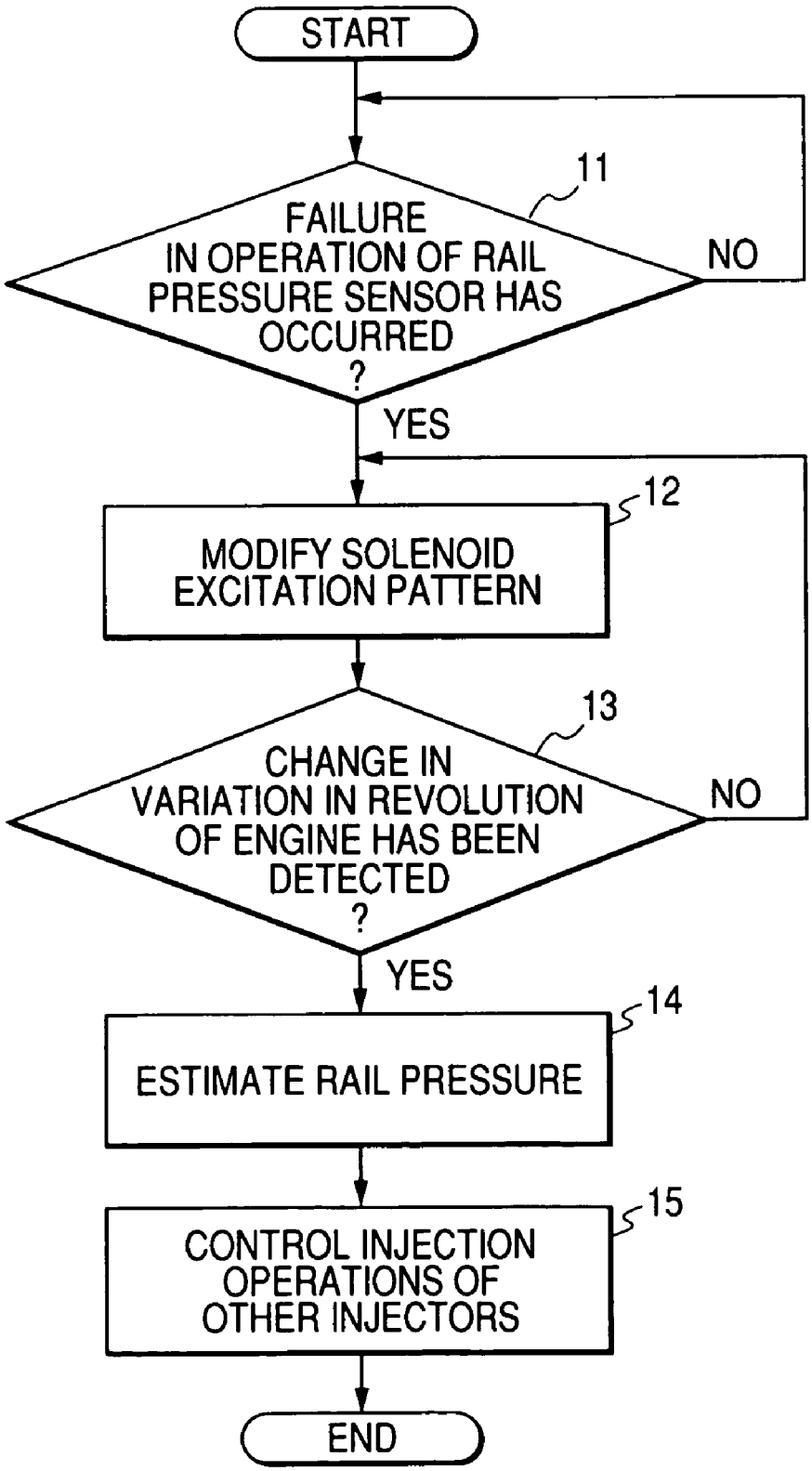
FIG. 7 is a flowchart of a program to be executed to estimate pressure in a common rail in the event of a change in performance of a rail pressure sensor and control subsequent injections of fuel into an engine in the second embodiment of the invention.

FIG. 7 is a flowchart of a program to be executed by the controller 5 of the fuel injection apparatus 1 of this embodiment.

First, in step 11, it is determined whether a fault in operation of the rail pressure sensor 3 has occurred or not. If a YES answer is obtained, then the routine proceeds to step 12. Alternatively, if a NO answer is obtained, then the routine repeats step 11.

In step 12, the solenoid excitation pattern is modified to decrease the maximum value of the greater current to be applied to the solenoid 11 of a selected one of the injectors 4 by an amount α. The controller 5 applies the current, as set by the modified solenoid excitation pattern, to the solenoid 11 of the selected one of the injectors 4.

The routine proceeds to step 3 wherein it is determined whether the change in variation in revolution of the engine has been detected or not. Specifically, when the variation in revolution of the engine, as produced by the fuel injection upon excitation of the solenoid 11 of the selected one of the injectors 4 in this program cycle, is substantially identical with that, as produced by the fuel injection upon excitation of the solenoid 11 of the same one of the injectors 4 one program cycle earlier, it is determined in step 3 wherein the change is variation in revolution of the engine has not appeared, then the routine returns back to step 12 wherein the maximum value of the greater current to be applied to the solenoid 11 of the selected one of the injectors 4 is further decreased by the amount α.

When the decrease in the current applied to the solenoid 11 of the injector 4 results in no injection of the fuel into the engine, thus leading to a drop in the variation in revolution of the engine which is greater than a given threshold level, a YES answer is obtained in step 13, when the routine proceeds to step 4. Specifically, step 13 works to determine whether the transition from detection to no detection of the change in variation in revolution of the engine has occurred or not. Step 12 continues to decrease, in sequence, the maximum value of the greater current to be applied to the solenoid 11 of the selected one of the injectors 4 until step 13 determines that the change in variation in revolution of the engine has been detected.

If a YES answer is obtained in step 13 meaning that the change in variation in revolution of the engine has appeared, then the routine proceeds to step 14 wherein the rail pressure Pc is calculated according to Eq. (3), as described above.

Finally, the routine proceeds to step 15 wherein the controller 5 controls injections of the fuel into the other cylinders of the engine using the rail pressure Pc, as calculated in step 14.

As apparent from the above discussion, the fuel injection apparatus 1 of this embodiment is designed to estimate the fuel pressure in the common rail 2 using the current applied to the solenoid 11 of a specified one of the injectors 4, as sampled upon appearance of the change in variation in revolution of the engine greater than the threshold level, that is, occurrence of no injection of the fuel into a corresponding one of the cylinders of the engine. This results in a decrease in occurrence of the change in variation in revolution of the engine, thus ensuring the stability of operation of the engine upon a failure in operation of the rail pressure sensor 3.

The fuel injection apparatus 1 according to the third embodiment will be described below.

Figure 8:
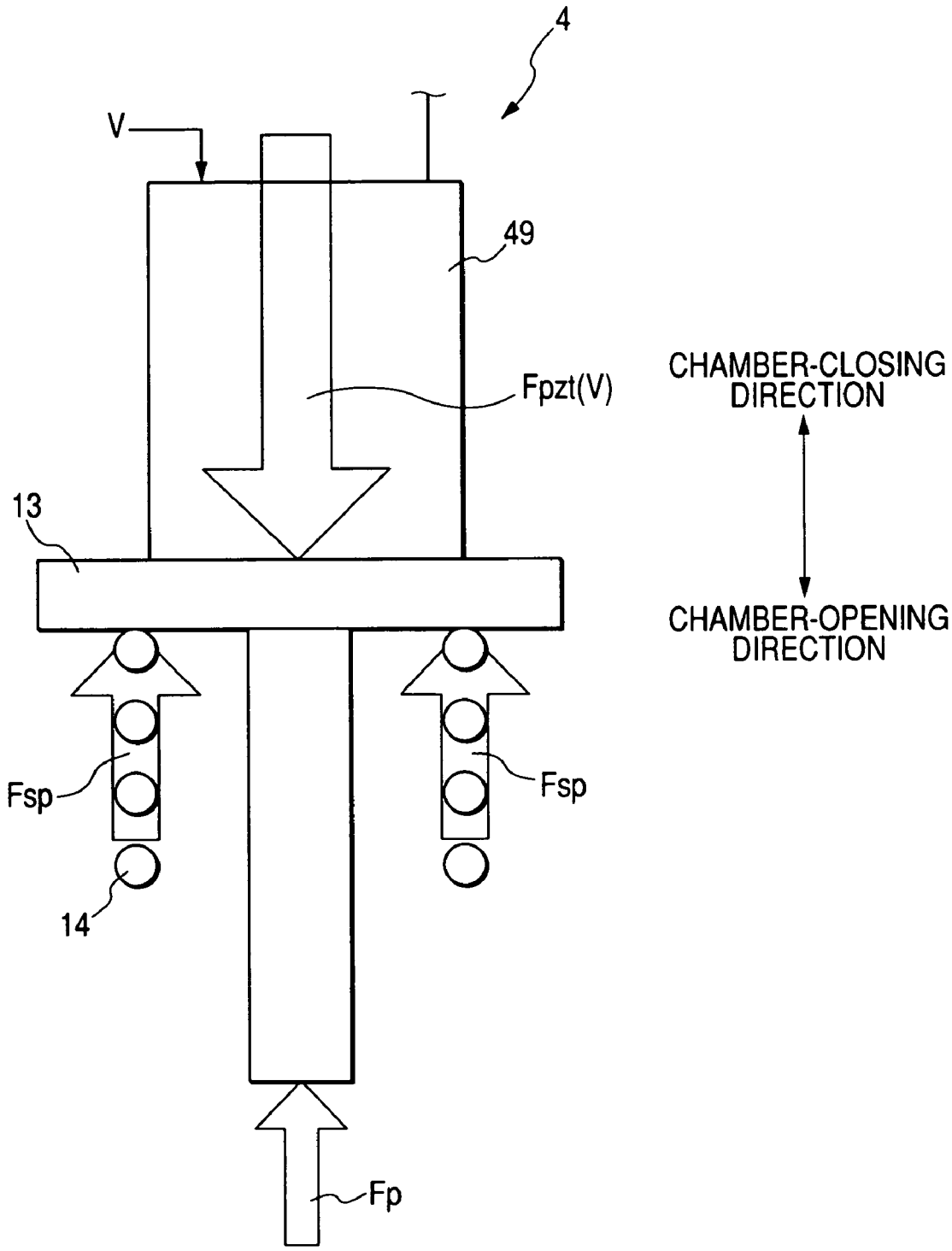
FIG. 8 is a schematic view which shows a physical balance among magnetic attraction, spring pressure, and pressure in a back pressure chamber which act on a control valve of an injector in a fuel injection apparatus of the third embodiment of the invention.

Each of the injectors 4, as employed in the fuel injection apparatus 1 of this embodiment, includes, as illustrated in FIG. 8, a piezoelectric actuator made of a piezoelectric device 49. When it is required to inject the fuel into one of the cylinders of the engine, the controller 5 applies the voltage to the piezoelectric device 49 of a corresponding one of the injectors 4. The piezoelectric device 49 is responsive to the application of voltage thereto to expand in a lengthwise direction thereof to produce a pressure or force Fpzt(V) (which will also be referred to as a piezo expansion force below) urging the control valve 13 to close the back pressure chamber 12. The magnitude of the piezo expansion force Fpzt(V) is a function of the voltage (V) applied to the piezoelectric device 49.

The controller 5 has a piezoelectric device excitation schedule, like the one of FIG. 2(*a*) or 2(*b*), which represents a sequential change in voltage to be applied to each of the piezoelectric device 49 of the injectors 4 when it is required to inject the fuel into the engine and works to change the maximum level of voltage to be applied to the piezoelectric devices 49 instead of changing the current to be applied to the solenoids 11 in the first and second embodiments to induce the change in variation in revolution of the engine.

Each of the injectors 4 is so designed that the chamber-opening and -closing directions in which the control valve 13 is moved to open and close the back pressure chamber 12, respectively, are reverse to those in the first embodiment. Specifically, the spring pressure Fsp is oriented in the same direction as that in the first embodiment (i.e., the chamber-closing direction). The back pressure force Fp is oriented in a direction reverse to that in the first embodiment (i.e. the chamber-closing direction). The piezo expansion force Fpzt (V), as produced by expansion of the piezoelectric device 49, is oriented in the same direction as that of the magnetic attraction Fsol (I) (i.e., the chamber-opening direction). Therefore, when no injection occurs, that is, when the sum of the back pressure force Fp and the spring pressure Fsp which urges the control valve 13 in the chamber-closing direction is balanced with the piezo expansion force Fpzt(V) which urges the control valve 13 in the chamber-opening direction, the following equation is met.

$$Fsp+Fp=Fpzt(V) \quad (4)$$

When Eq. (4) is met, the pressure in the back pressure chamber 12, like the first embodiment, will be identical with the rail pressure. The back pressure force Fp may, thus, be expressed by Eq. (2), as described above. The spring pressure Fsp is constant. Therefore, when the above balance is achieved, the rail pressure Pc may be expressed by an equation (5) below using the magnitude of voltage applied to the piezoelectric device 49.

$$Pc=Fpzt(V)/A-Fsp/A \quad (5)$$

Other arrangements or operations of the fuel injection apparatus 1 are identical with those in either of the first or second embodiment, and explanation thereof in detail will be omitted here.

In each of the first to third embodiments, a change in pressure in a selected one of the cylinders of the engine may be monitored, instead of the change in variation in revolution of the engine, to determine whether the injector 4 is physically balanced or not, that is, whether Eq. (1) or (4) is met or not. In step 15 of the second embodiment, the controller 5 may alternatively correct, like the first embodiment, the correlation between the rail pressure and the output of the rail pressure sensor 3 using the rail pressure Pc, as calculated in step 14, and an actual output of the rail pressure sensor 3, as sampled when the change in variation in revolution of the engine is detected and use the corrected correlation in controlling subsequent injections of the fuel into the engine.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A fuel injection apparatus for an engine comprising:

a common rail accumulating fuel under a given pressure;

a rail pressure sensor disposed to measure pressure of the fuel in said common rail and provide an output indicative thereof;

fuel injectors each including an injector body, an injection valve, a pressure chamber, a control valve, a spring, and an actuator, the spring urging the control valve to close the pressure chamber, so that pressure in the pressure chamber acts on the injection valve to close a spray hole formed in the injector body, the actuator being supplied with electricity to move the control valve to open the pressure chamber, so that the pressure in the pressure chamber changes to move the control valve to open the spray hole for initiating injection of fuel into a corresponding one of cylinders of an engine;

a controller working to control the electricity supplied to the actuator of each of said fuel injectors using the output from said rail pressure sensor for controlling the injection of the fuel into the engine and also monitor an operation state of said rail pressure sensor, when having determined that the operation state of said rail pressure sensor is unusual, said controller changing a value of the electricity supplied to the actuator to determine whether a resulting change in a preselected operation characteristic of the engine has appeared or not, when it is determined that the resulting change has appeared, said controller calculating a value of the rail pressure using the changed value of the electricity and a physical property of balance among forces acting on the control valve on one of said fuel injectors which has induced the change in operation characteristic of the engine.

2. A fuel injection apparatus as set forth in claim 1, wherein said controller corrects a correlation between the rail pressure and the output of said rail pressure sensor using the calculated value of the rail pressure and an actual value of the output from said rail pressure sensor and when it is determined that the resulting change in the preselected operation characteristic of the engine has appeared, said controller using the corrected correlation to control the electricity to said fuel injectors for subsequent injection of the fuel into the engine.

3. A fuel injection apparatus as set forth in claim 1, wherein said controller uses the calculated value of the rail pressure to control operations of the fuel injectors for subsequent injections of the fuel into the engine.

4. A fuel injection apparatus as set forth in claim 3, wherein said controller selects one of the cylinders of the engine as a target cylinder to be monitored in the resulting change in the preselected operation characteristic of the engine, said controller changing the value of the electricity supplied to one of said fuel injectors which is provided for the target cylinder cyclically until the resulting change in the preselected operation characteristic of the engine appears and calculating the value of the rail pressure using the value of the electricity changed upon appearance of the resulting change in the preselected operation characteristic and the physical property of balance among forces acting on the control valve of the one of said fuel injectors for controlling operations of others of the fuel injectors for subsequent injections of the fuel into the engine.

5. A fuel injection apparatus as set forth in claim 1, wherein the preselected operation characteristic of the engine is an increase in revolution of the engine during an expansion stroke thereof.

6. A fuel injection apparatus as set forth in claim 1, wherein the actuator of each of said fuel injectors is implemented by a solenoid which is supplied with an electric current to produce a magnetic attraction acting on the control valve to open the pressure chamber, and wherein the level of the electricity to be changed by said controller to induce the change in the preselected operation characteristic of the engine is a maximum value of the electric current.

7. A fuel injection apparatus as set forth in claim 1, wherein the actuator of each of said fuel injectors is implemented by a piezoelectric device which is responsive to input of voltage to expand to move the control valve to open the pressure chamber, and wherein the level of the electricity to be changed by said controller to induce the change in the preselected operation characteristic of the engine is a maximum value of the voltage to the piezoelectric device.

8. A fuel injection control method for an engine, said method comprising:

accumulating fuel under a given pressure in a common rail;

measuring fuel pressure in said common rail using a rail pressure sensor;

using fuel injectors each including an injector body, an injection valve, a pressure chamber, a control valve, a spring, and an actuator, the spring urging the control valve to close the pressure chamber, so that pressure in the pressure chamber acts on the injection valve to close a spray hole formed in the injector body;

supplying the actuator with electricity to move the control vale to open the pressure chamber so that the pressure in the pressure chamber changes to move the control valve to open the spray hole for initiating injection of fuel into a corresponding cylinder of an engine;

controlling the electricity supplied to the actuator of each said fuel injector using the measured fuel pressure to control injection of fuel into the engine;

monitoring an operational state of the rail pressure sensor and (a) when having determined that the operational state of said rail pressure sensor is unusual, changing the electricity supplied to the actuator to determine whether a resulting change in a preselected operation characteristic of the engine has appeared or not and (b) when it is determined that the resulting change has appeared, calculating a rail pressure valve using the changed value of the electricity and a physical property of balance among forces acting on the control valve of one of said fuel injectors which has induced a change in operation characteristic of the engine.

9. A method as in claim 8 wherein a correlation between the rail pressure and output of said rail pressure sensor is corrected using the calculated rail pressure value and an actual value of output from said rail pressure sensor and when it is determined that the resulting change in the preselected operation characteristic of the engine has appeared, using the corrected correlation to control the electricity to said fuel injectors for subsequent injection of fuel into the engine.

10. A method as in claim 8 wherein the calculated rail pressure value is used to control operations of the fuel injectors for subsequent injections of fuel into the engine.

11. A method as in claim 10 wherein one of the cylinders of the engine is selected as a target cylinder to be monitored in the resulting change in the preselected operation characteristic of the engine, said value of the electricity supplied to one of said fuel injectors which is provided for the target cylinder being changed cyclically until the resulting change in the preselected operation characteristic of the engine appears and calculating the rail pressure valve using the value of the change in electricity upon appearance of the resulting change in the preselected operation characteristic and the physical property of balance among forces acting on the control valve of the one of said fuel injectors used for controlling operations of others of the fuel injectors for subsequent injections of fuel into the engine.

12. A method as in claim 8 wherein the preselected operation characteristic of the engine is an increase in rpm of the engine during an expansion stroke thereof.

13. A method as in claim 8 wherein the actuator of each of said fuel injectors is implemented by a solenoid which is supplied with an electric current to produce a magnetic attraction acting on the control valve to open the pressure chamber, and wherein the level of the electricity to be changed to induce the change in the preselected operation characteristic of the engine is a maximum value of the electric current.

14. A method as in claim 8 wherein the actuator of each of said fuel injectors is implemented by a piezoelectric device which is responsive to input of voltage to expand to move the control valve to open the pressure chamber, and wherein the level of the electricity to be changed to induce the change in the preselected operation characteristic of the engine is a maximum value of the voltage applied to the piezoelectric device.

* * * * *